United States Patent [19]

Cray et al.

[11] 4,422,613

[45] Dec. 27, 1983

[54] PICTURE FRAME EASELS

[75] Inventors: Nicholas K. Cray, Schiller Park, Ill.; Frederick L. Murrin; Phillip E. Maupin, both of Greenville, Pa.

[73] Assignee: R. D. Werner Co., Inc., Greenville, Pa.

[21] Appl. No.: 389,846

[22] Filed: Jun. 18, 1982

[51] Int. Cl.[3] ..... A47F 7/14

[52] U.S. Cl. ..... 248/473; 248/441 R; 40/152.1

[58] Field of Search ..... 248/441.1, 444.3, 472, 248/455, 456, 463, 473, 442, 450, 174, 443; 40/152.1

[56] References Cited

U.S. PATENT DOCUMENTS

| | | | |
|---|---|---|---|
| 1,266,694 | 5/1918 | Lieber | 248/441.1 |
| 1,681,586 | 8/1928 | Kessler | 248/441.1 X |
| 2,140,225 | 12/1938 | Hansson | 248/473 |
| 3,787,922 | 1/1974 | Foy et al. | 248/473 X |

FOREIGN PATENT DOCUMENTS

| | | | |
|---|---|---|---|
| 15863 | 9/1980 | European Pat. Off. | 248/473 |

*Primary Examiner*—J. Franklin Foss
*Assistant Examiner*—Sarah A. Lechok
*Attorney, Agent, or Firm*—J. Helen Slough

[57] ABSTRACT

An easel for use with a back-loading picture frame, which easel is readily attachable and detachable therefrom and intended for use primarily with picture frames formed from metal in extruded channel shapes. The easel preferably is of resilient extruded material and has a flat land member and a resilient yoke member extending at an angle thereto. The yoke is provided with a pair of spaced members, one member being adapted to be fit within the channel in one frame section adjacent a forward face of the frame and the other member fit within the channel adjacent a rear face of the frame section, said members adapted to be secured by means of spring pressure into locking engagement with means on the frame section and easily detached therefrom.

9 Claims, 8 Drawing Figures

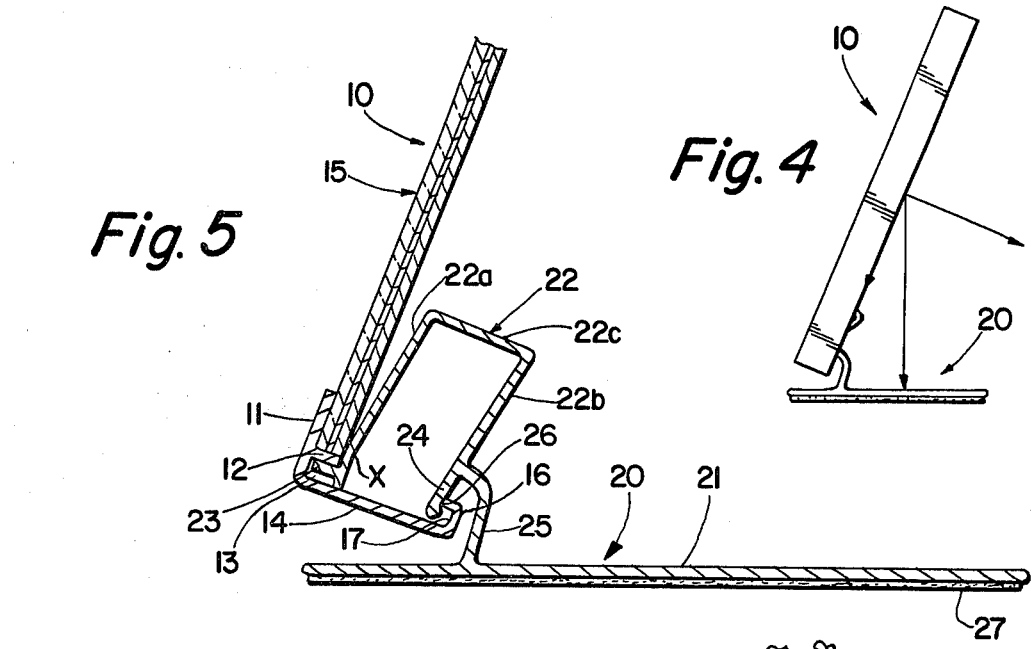
Fig. 5
Fig. 4
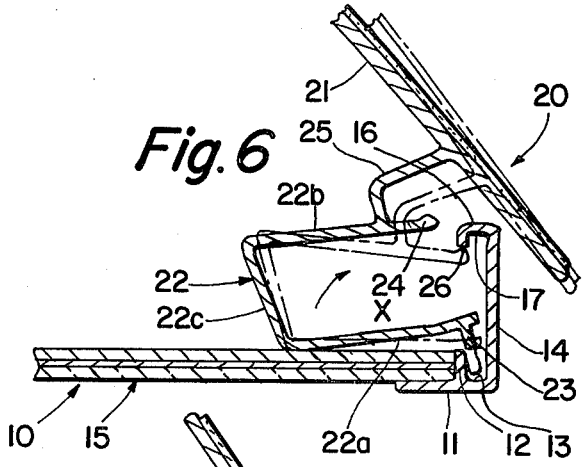
Fig. 6
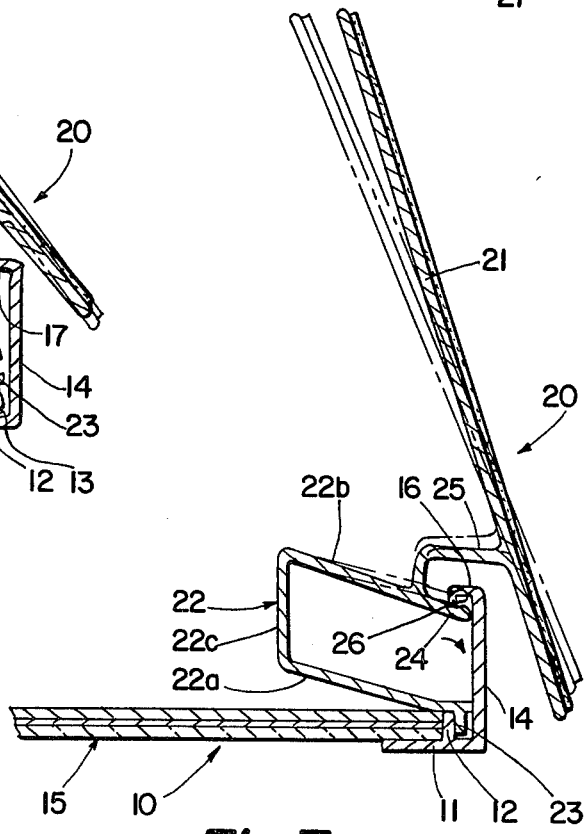
Fig. 7
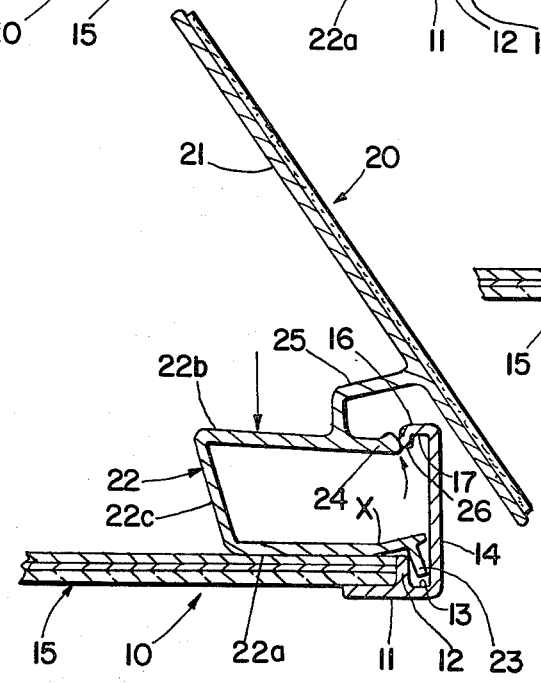
Fig. 8

PICTURE FRAME EASELS

This invention relates to an easel for attachment to a picture frame and frame sections formed from extruded metal such as aluminum.

Such picture frames or frame sections are normally of the back-loading type and formed with channel shaped sides facing rearwardly on the adjacent back surfaces of the frame, as shown in U.S. Letters Pat. No. 4,216,597 dated Aug. 12, 1980 granted to assignee of the present application.

The easel of this invention is particularly adapted to be operatively attachable to or detachable from such frames or frame sections and to be snapped on or off of the frame etc. as desired.

It is an object of this invention to provide improvements in an easel for picture frames or frame sections to convert the said frames or frame sections from suspended into free standing upright or nearly upright positions.

A further object of this invention is to provide an easel which may be quickly and easily attached to or detached from the frame or frame sections.

Still another object of this invention is to provide improvements in said easels whereby the same may be securely locked to the frame or frame sections in its operative position.

A still further object of the invention is to provide said frames with adequate and secure seating on a flat surface such as a ledge, shelf, table or the like.

Other objects of my invention and the invention itself will become more readily apparent to those skilled in the art to which the invention appertains as will be apparent from the appended description and drawings, in which drawings:

FIG. 4 is a side elevational view of the frame with easel attached showing the points of moment of the said frame and easel;

FIG. 5 is a cross-sectional view taken from the line 5—5 of FIG. 2;

FIG. 6 is a cross-sectional view showing a first step in the attachment of the easel to the frame, the frame being placed face down on a flat surface, a curved arrow indicating the direction of pivot of the easel; solid lines indicating the initial position of the easel and dotted lines an intermediate adjusted position of the same;

FIG. 7 is a cross-sectional view similar to the view of FIG. 5 showing a second step in attaching the easel to the frame, a curved arrow indicating the pivotal direction of the easel; dotted lines indicating the intermediate position of the easel and solid lines indicating the final locked position of the easel on the frame;

FIG. 8 is a cross-sectional view similar to FIGS. 5 and 6 illustrating the manner of removal of the easel from the frame, a curved arrow indicating the pivotal direction of the easel during the removal and a straight arrow indicating the direction in which manual pressure is exerted to facilitate removal of the said easel from the frame.

Figure 3:
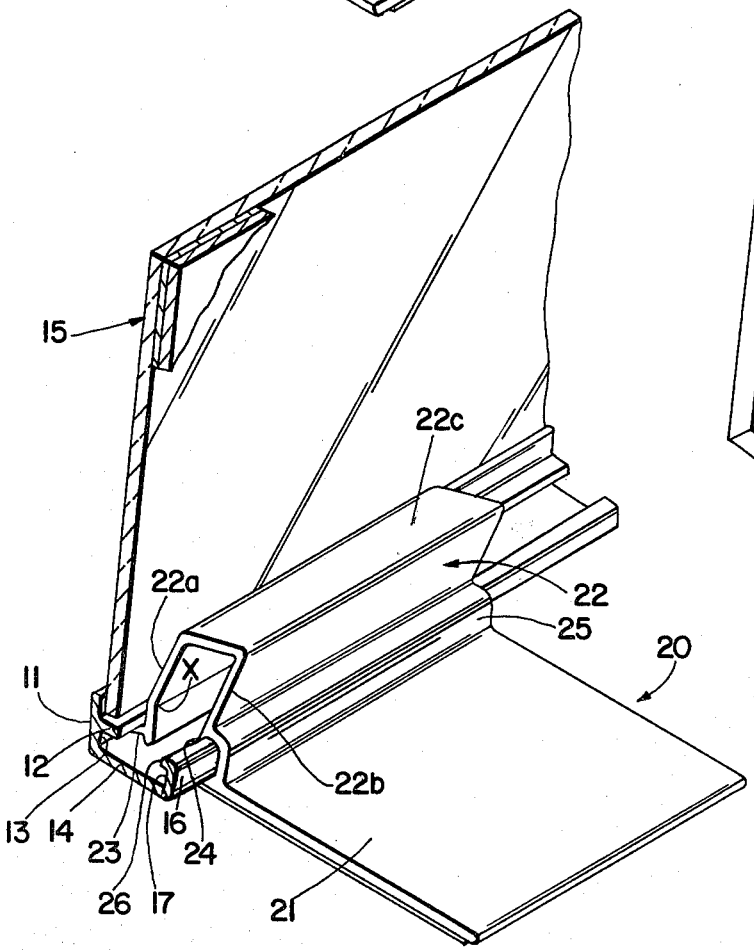
FIG. 3 is a fragmentary view of a portion of the rear of a picture frame showing the easel of FIG. 1 attached thereto.

Referring now to the drawings, in all of which like parts are designated by like reference characters, at 10 is shown a back-loading picture frame to which, or from which, the easel 20 of my invention is adapted to be attached or detached. The frame 10 which is preferably made of extruded material, such as aluminum or the like, comprises a plurality of frame side sections, said frame sections each being similarly channel-shaped as shown in FIGS. 3 and 5 to 8 inclusive. The frame comprises a front member 11, side members 14 and a back member 16, the front and back members 11 and 16 being generally in spaced parallel relationship. A rearwardly extending ridge or rib 12 is disposed on the front member 11 which rib extends rearwardly and generally perpendicularly to the front member and is spaced from and positioned above the lower edge of the front member, a groove 13 being formed thereby between the ridge 12 and the side wall 14. The upper surface of the rib, as best illustrated in FIG. 3 is adapted to hold display or picture material generally indicated at 15 and said material is adapted to be retained within the frame 10 preferably by spring means or clips (not shown) such as those described and shown in U.S. Letters Pat. No. 4,216,597. The back member 16 is, as shown herein, formed with a lip member 26 preferably disposed generally perpendicular to the back member 16 in spaced planar relation to the ridge 12, a groove 17 being formed thereby between the side member 14 and the lip 26.

The easel 20 of this invention is formed of extruded resilient material, such as aluminum or the like, and comprises a flat land member 21, a channel-shaped generally resilient U-shaped yoke having a web **22*c*, a pair of spaced downwardly angled, elongated legs 22*a* and 22*b* of substantially equal length, the forward leg 22*a* as shown in FIG. 3 on the left being provided with a projection or nose 23 adjacent to but spaced slightly above the free end of the forward leg 22*a* which leg is angled inwardly as shown from a point "X" to the free end of the said leg. The rearmost leg 22*b* shown at the right of FIG. 3 is provided with a scut or tail 24** adjacent its outer free end.

The easel is adapted to be secured to the frame by preferably first laying the frame face down, as shown in FIG. 6 and projecting the nose 23 of the forward leg into the groove 13 as shown in dotted lines in that figure and hooking the projection behind the rib 12. The angling of the leg **22*a* provided from the point "X" to the free end of the said leg enables the flat projection or nose 23 to be easily inserted behind the rib and to abut the same as shown in FIGS. 3 and 7. The easel is then rotated about the nose 23, as best shown in dotted lines, the direction of rotation being indicated by the curved arrow in FIG. 7, and said rotation is continued until the tail 24 snaps under the lip 26 of the back member 16 as shown in FIG. 5 and behind the rib as shown in FIGS. 6, 7 and 8**. The easel is thus held securely locked into the frame and held within both the front and rear frame sections.

To detach the easel from the frame, the frame is again placed face down on a flat surface and with one hand placed upon the back of the frame, manual pressure is used to press firmly down on the easel, particularly on the leg **22*b* to release the tail from its locked position with the lip 26 and to disengage the nose from its position in the groove 13 as shown in FIG. 8. The straight arrow in this figure indicates the direction of the pressure exerted on the leg 22*b*** and the curved arrow indicates the direction of rotation of the easel during removal of the same from the frame.

Figure 1:
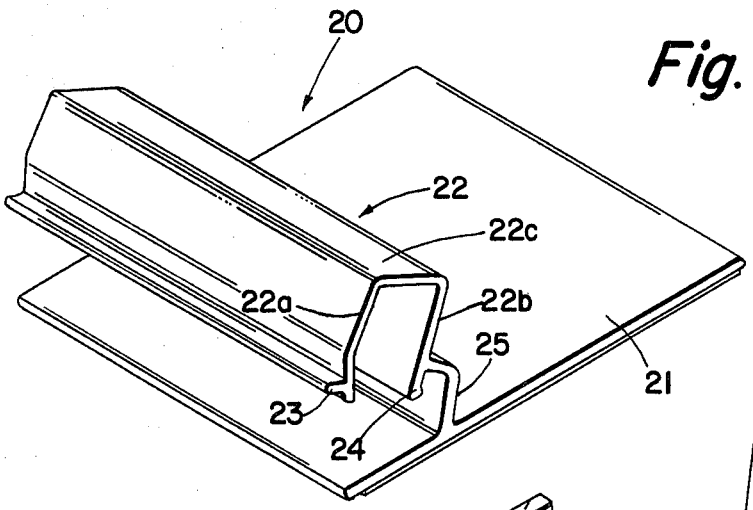
FIG. 1 is a front perspective view of the easel of this invention.
Figure 2:
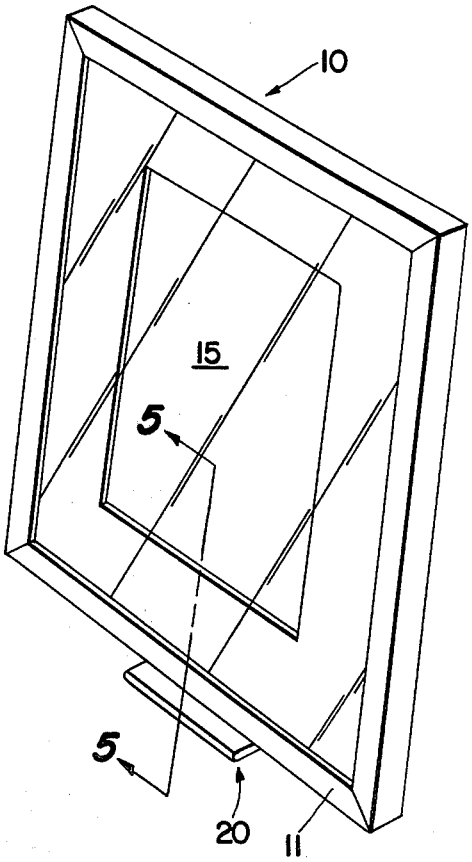
FIG. 2 is a perspective view of a portion of the front of a picture frame showing the easel attached thereto.

It is to be noted that the yoke 22*c* is disposed at an angle to and in spaced relation to a flat land member 21 integral therewith by an interconnecting generally inversely L-shaped brace 25 secured to the leg 22*b* and to a portion of the land member 21 between the ends thereof which land member, when the frame is raised as shown in FIGS. 2, 3, 4 and 5, is adapted to be placed on a flat surface such as a table top or shelf or ledge, to dispose the picture frame in an upright position as shown in FIGS. 2,3,4 and 5, the easel supporting the same in such position. It will be noted in such standing position the forward end of the land member is, as shown in FIGS. 2 and 4, in spaced underlying relation to the bottom edge of the frame. The spacing, however, is not critical. As shown the land member 21 is provided with an underlying layer of felt or other mat or pad material 27. It is to be understood that the easel and frame to which it is attached should be of such relative size, weight, and dimensions as to ensure stable seating of the frame on the easel and prevent the unseating therefrom.

It will be noted that the yoke is extruded from resilient material such as aluminum, that the leg 22*b* can thus yield and be drawn towards the leg 22*a* and thus exert spring pressure against the front and back members when the easel is attached to the frame and upon exertion of manual pressure upon it to release the leg 22*b* from its locked engagement in the groove 17 created between the lip 26 of the rear face 16 of the frame and the side frame section 14, as illustrated in FIG. 8, wherefor the leg 22*a* can be easily removed from the groove 13 created between the rib 12 and side frame section 14.

The spacing, it will be observed, provided between the legs 22*a* and 22*b*, initially hence is greater than the space between the ends of the spaced facing inner ends of the lip 26 and rib 12, which are in planar relationship, and hence when the easel is secured as shown to the frame, exert spring pressure against the lip and rib to ensure locking engagement with the frame.

While the invention is described in connection with a preferred embodiment, it will be understood to those skilled in the art that variations and modifications to both the frame and the easel may be made without, however, departing from the spirit of the invention and scope of the appended claims.

What we claim is:

1. An easel for detachably supporting and mounting a back-loading picture frame of channel shape having upstanding front and rear faces, said easel comprising a flat land member adapted to underlie said frame, a resilient yoke member secured to said land member and including a pair of spaced legs disposed in angled relation to said land member, said legs and said front and rear faces of the frame having means associated therewith adapted to contact the said legs whereby the legs are adapted to be lockingly retained in spring pressed relation against said front and rear faces and removable therefrom by exertion of pressure upon said legs.

2. An easel as claimed in claim 1 having a brace interconnecting the land member and said yoke member.

3. An easel as claimed in claim 1 wherein an end of one of the said legs of the easel is adapted to be rotated about a fixed point of contact with the front face of the frame whereby the other leg may be brought into engagement with the rear face of the frame.

4. An easel for a frame as claimed in claim 3 wherein the free end of the rotatable leg is provided with a projection adapted to engage means on the front face of the channel shaped frame to retain the said leg in locked engagement with the front face of the frame when the frame is mounted on the easel.

5. An easel for a frame as claimed in claim 3 wherein the rear face of the channel shaped frame is provided with means adapted to retain the other leg of the yoke member in locked engagement with the said rear face.

6. An easel for detachably supporting back-loading picture frames of channel shape having upstanding front and rear faces and side faces, said easel comprising a flat land member, a yoke member secured to said land member and including a web and a pair of spaced legs in angled relation to said land member, one of said legs having a projection extending outwardly of and adjacent the free end thereof; the other of said legs having a tail adjacent its free end, the said projection and tail being on opposite sides of the respective said legs whereby the easel legs can be respectively secured to a forward and rear face of said frame.

7. An easel as claimed in claim 6 wherein the yoke member is a resilient member and the leg having the projection is adapted to engage the front face of the frame and the tail of the other leg is adapted to engage the rear face of said frame.

8. An easel as claimed in claim 6 wherein the yoke having the projection is provided with an inwardly inclined free end.

9. An easel for a back-loading picture frame which frame has along its front face a rearwardly extending rib and along its rear portion an inwardly extending lip, said rib and lip being disposed in spaced relation, said easel comprising a flat land member, a yoke member secured to said land member and including a web and a pair of spaced legs in angled relation to said land member, one of said legs having a projection extending outwardly of and adjacent the free end thereof; the other of said legs having a tail adjacent its free end, the said projection and tail being on opposite sides of the respective said legs whereby the projection is adapted to engage said rib and the tail of the other leg the lip to secure the easel legs to the forward and rear face of said frame.

* * * * *